US010139085B2

(12) United States Patent
Hsieh

(10) Patent No.: US 10,139,085 B2
(45) Date of Patent: Nov. 27, 2018

(54) LAMP DEVICE WITH LAMPSHADE FASTENED VIA ARM LATCH

(71) Applicant: HABITEX CORPORATION, Taipei (TW)

(72) Inventor: Pei-Lin Hsieh, Taipei (TW)

(73) Assignee: HABITEX CORPORATION, Taipei (TW)

( * ) Notice: Subject to any disclaimer, the term of this patent is extended or adjusted under 35 U.S.C. 154(b) by 168 days.

(21) Appl. No.: 15/425,491

(22) Filed: Feb. 6, 2017

(65) Prior Publication Data

US 2018/0224092 A1 Aug. 9, 2018

(51) Int. Cl.

| | |
|---|---|
| ***F21V 17/10*** | (2006.01) |
| ***F21V 1/14*** | (2006.01) |
| ***F21V 1/12*** | (2006.01) |
| ***F21V 17/06*** | (2006.01) |
| ***F21V 17/20*** | (2006.01) |
| ***F21V 17/18*** | (2006.01) |

(52) U.S. Cl.

CPC ..... *F21V 17/10* (2013.01); *F21V 1/12* (2013.01); *F21V 1/14* (2013.01); *F21V 17/06* (2013.01); *F21V 17/18* (2013.01); *F21V 17/20* (2013.01)

(58) Field of Classification Search

CPC ..... F21V 17/06; F21V 17/10; F21V 17/107; F21V 17/18; F21V 17/20; F21V 1/12; F21V 1/14

See application file for complete search history.

(56) References Cited

U.S. PATENT DOCUMENTS

| | | | | |
|---|---|---|---|---|
| 2,137,026 | A * | 11/1938 | Phillips | F21V 17/00 220/2.3 R |
| 6,203,178 | B1 * | 3/2001 | Hsieh | F21S 6/002 362/353 |
| 2004/0022060 | A1 * | 2/2004 | Chung | F21V 17/10 362/352 |
| 2009/0079202 | A1 * | 3/2009 | Wolf | E05C 3/046 292/36 |
| 2013/0294091 | A1 * | 11/2013 | Hsieh | F21V 3/00 362/361 |

* cited by examiner

*Primary Examiner* — Anh Mai
*Assistant Examiner* — Michael Chiang
(74) *Attorney, Agent, or Firm* — Hamre, Schumann, Mueller & Larson, P.C.

(57) ABSTRACT

A lamp device includes a lamp seat, a lampshade having an inner inclined surface and defining an opening, and a securing unit having a cover shell and a plurality of locking mechanisms. The cover shell is disposed in the opening and connected to a mounting plate of the lamp seat. Each locking mechanism has a locking member having a ring portion that is disposed rotatably in a respective one of receiving notches of the cover shell, and an arm portion that is co-rotatable with the ring portion between an unlocked position, and a locked position where the arm portion is disposed outside of the respective one of the receiving notches and abuts against the inner inclined surface, such that the lampshade is fastened to the lamp seat.

6 Claims, 13 Drawing Sheets

LAMP DEVICE WITH LAMPSHADE FASTENED VIA ARM LATCH

FIELD

The disclosure relates to a lamp device, and more particularly to a lamp device which can be conveniently assembled.

BACKGROUND

Referring to FIGS. 1 and 2, a conventional lamp device 9 includes a cover shell 91, a lampshade 92 made of glass, and a lamp seat 93 having a mounting plate 931. Generally, to assemble the conventional lamp device 9, the lampshade 92 is first pressed by the cover shell 91 to abut against the lamp seat 93, then the cover shell 91 is fastened to the mounting plate 931 of the lamp seat 93 with a plurality of screws 94, thereby allowing the lampshade 92 to be fastened to the lamp seat 93.

Referring to FIG. 3, since the cover shell 91 is relatively rigid, when the screws 94 are over-tightened, the lampshade 92, which is pressed by a surrounding wall 911 of the cover shell 91, may eventually fracture. But when the screws 94 are not sufficiently tightened, the lampshade 92 may fall out from the lamp seat 93. As a result, the conventional lamp device 9 is generally assembled before being purchased by a customer, so as to prevent the customer from breaking the lampshade 92 of the lamp device 9 when tightening the screws 94.

However, once the conventional lamp device 9 is assembled, storage and transportation of the conventional lamp device 9 will become more complicated, thereby leading to an increase of the price of sales and inconvenience.

SUMMARY

Therefore, an object of the disclosure is to provide a lamp device that can alleviate at least one of the drawbacks of the prior art.

According to the disclosure, the lamp device includes a lamp seat, a funnel-shaped lampshade, and a securing unit. The lamp seat includes a mounting plate. The lampshade has a top end portion, a bottom end portion, and an inner inclined surface. The bottom end portion is spaced apart from the top end portion, is connected to the mounting plate, and defines an opening. The lampshade converges from the top end portion to the bottom portion. The inner inclined surface extends from the bottom end portion to the top end portion. The securing unit has a cover shell and a plurality of locking mechanisms. The cover shell is disposed in the opening, and has a top wall, a surrounding wall, and a plurality of receiving notches. The surrounding wall extends downwardly from a periphery of the top wall, and is connected to the mounting plate. Each of the receiving notches extends from the top wall to the surrounding wall. Each of the locking mechanisms has a ring portion and an arm portion. The ring portion is disposed in a respective one of the receiving notches, and is rotatable about an axis relative to the cover shell. The arm portion extends laterally from the ring portion, and is co-rotatable with the ring portion about the axis relative to the cover shell between a locked position, where the arm portion is disposed outside of the respective one of the receiving notches and abuts against the inner inclined surface of the lampshade, such that the lampshade is fastened to the lamp seat, and an unlocked position, where the arm portion is received in the respective one of the receiving notches, such that the lampshade is permitted to be separated from the lamp seat.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
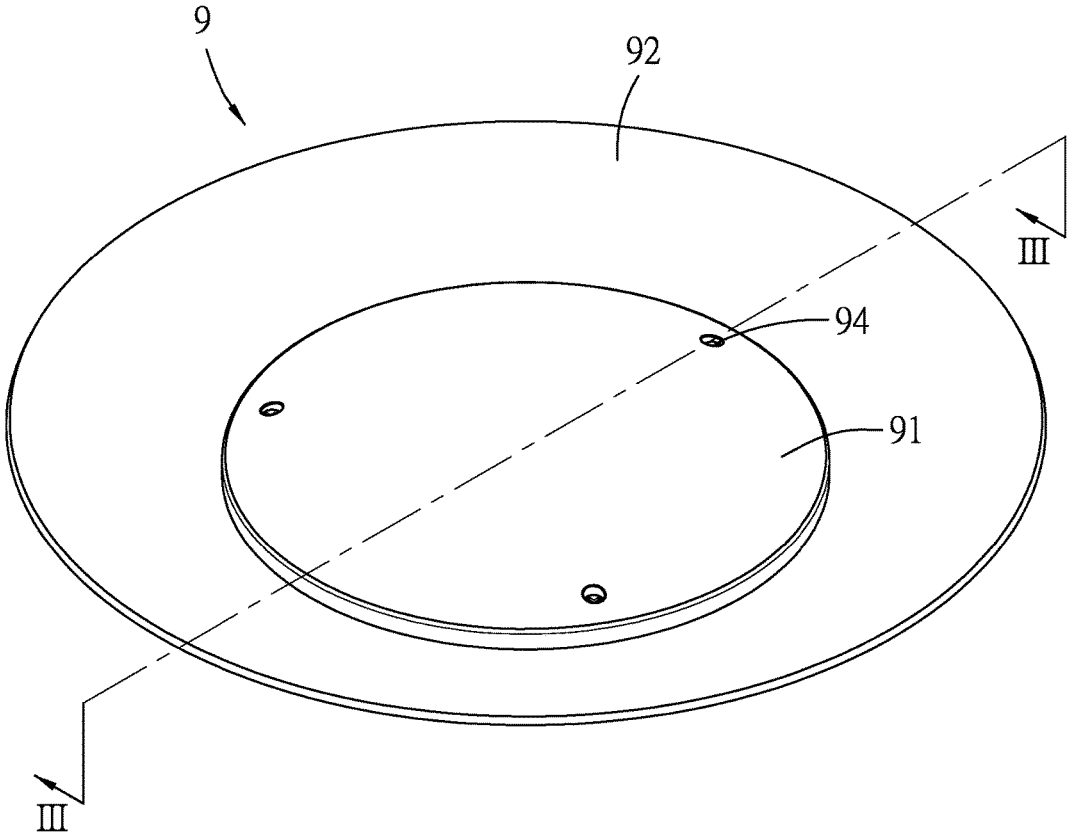
FIG.1 PRIOR ART
FIG. 1 is an assembled perspective view of a conventional lamp device.
Figure 2:
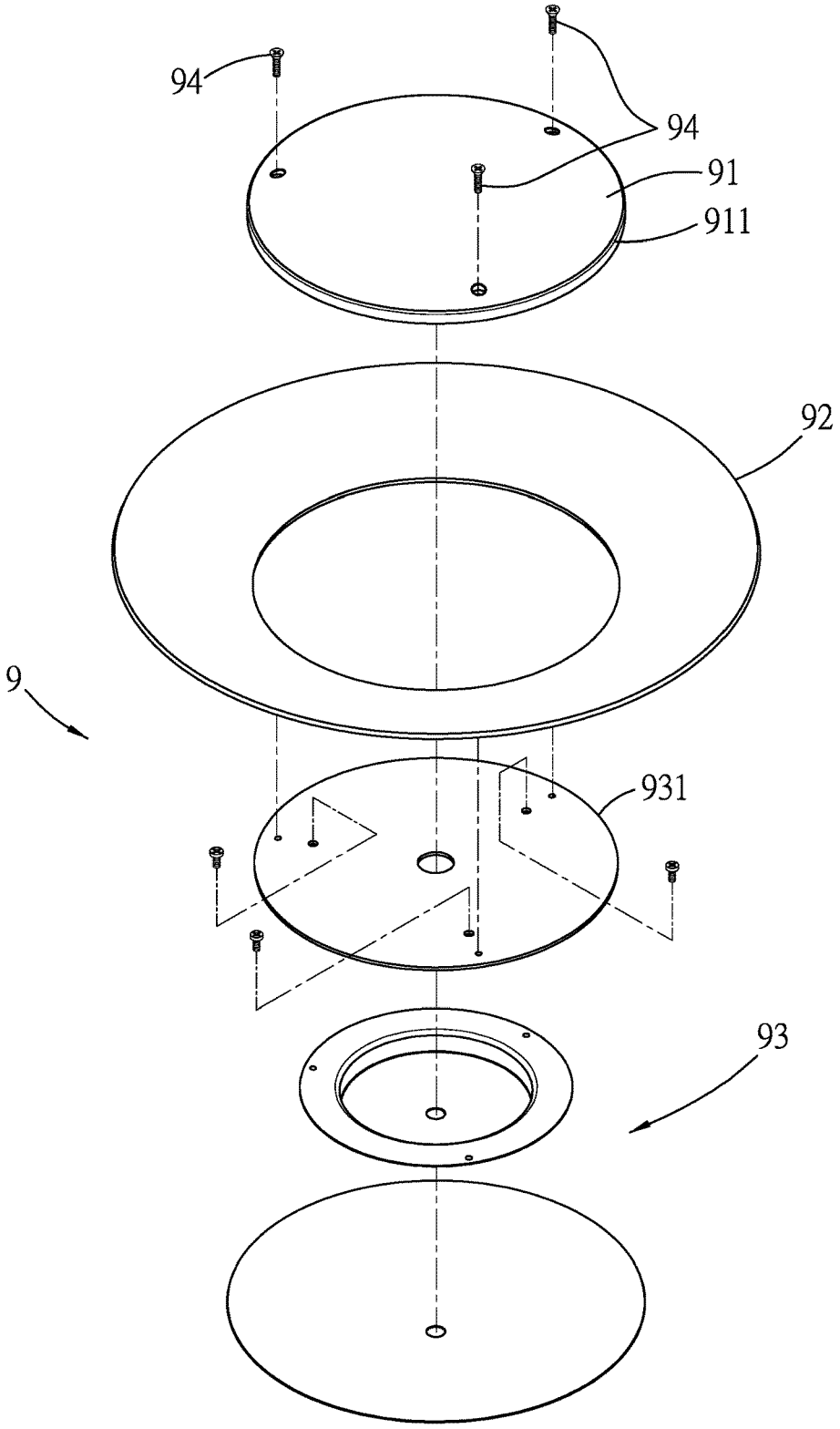
FIG.2 PRIOR ART
FIG. 2 is an exploded perspective view of the conventional lamp.
Figure 3:
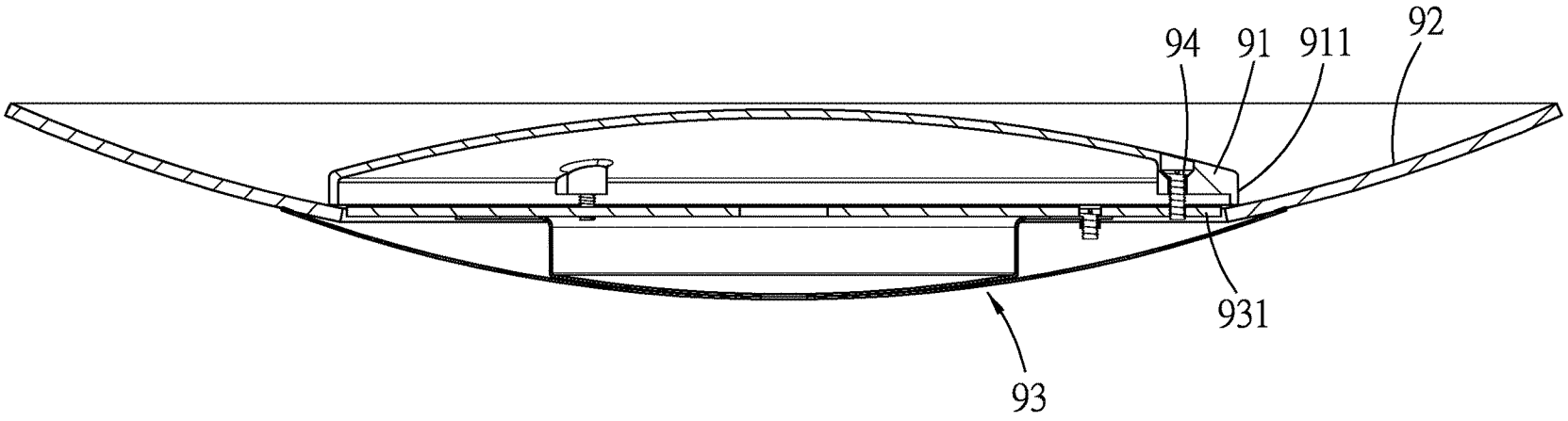
FIG.3 PRIOR ART
FIG. 3 is a sectional view taken along line III-III in FIG. 1.
Figure 4:
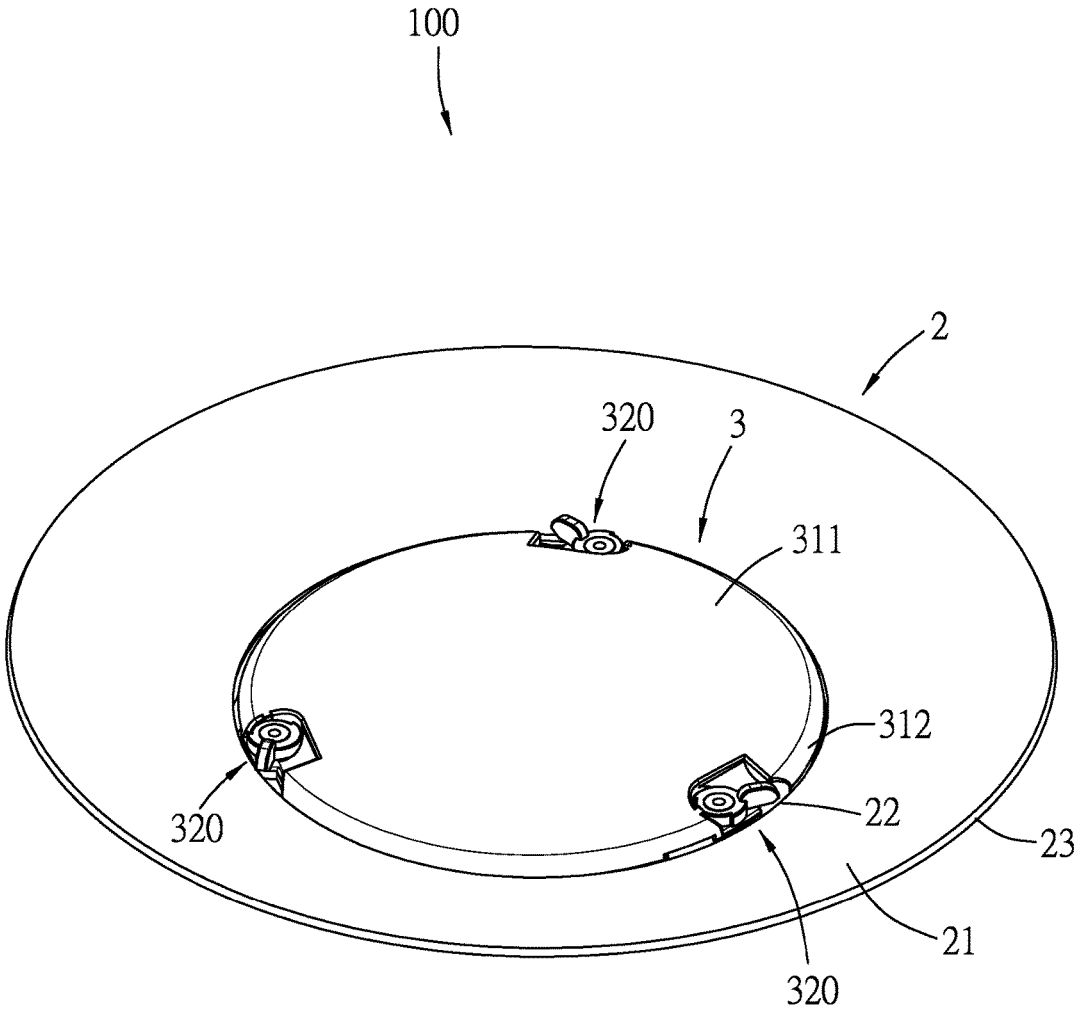
FIG. 4 is an assembled perspective view of an embodiment of a lamp device according to the present disclosure.
Figure 5:
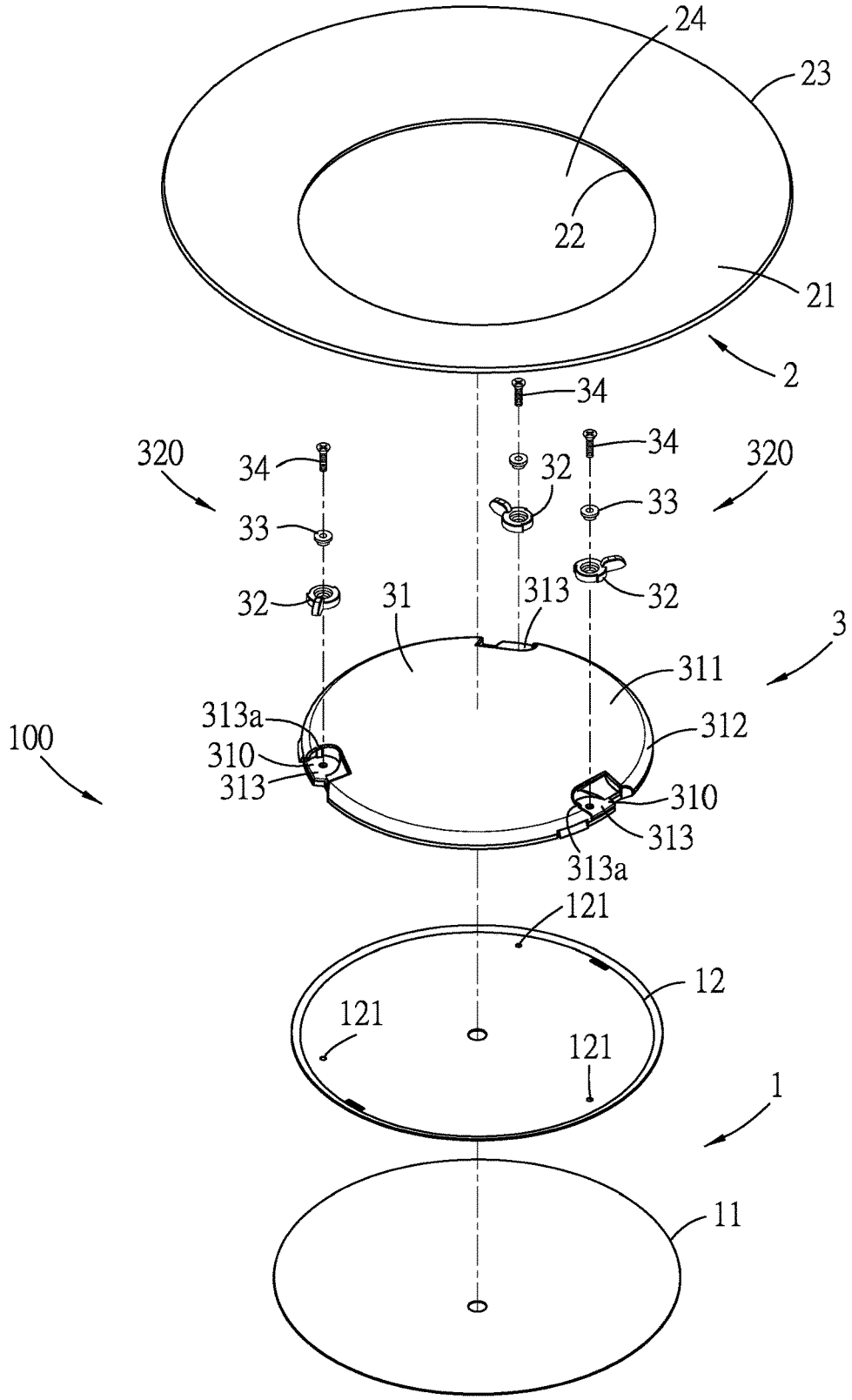
FIG. 5 is an exploded perspective view of the embodiment.

Referring to FIGS. 4 and 5, an embodiment of a lamp device 100 according to the disclosure includes a lamp seat 1, a lampshade 2, and a securing unit 3.

The lamp seat 1 includes a bottom plate 11 and a mounting plate 12. In this embodiment, the mounting plate 12 is formed with three angularly spaced-apart threaded holes 121, but the number and the arrangement of the threaded holes 121 may vary in other embodiments. The mounting plate 12 is welded on the bottom plate 11 in this embodiment, and may be connected to the bottom plate 11 using a different technique in other embodiments.

The lampshade 2 is funnel-shaped, and has a top end portion 23, a bottom end portion 22, and an inner inclined surface 21. The bottom end portion 22 is spaced apart from the top end portion 23, is connected to the mounting plate 12, and defines an opening 24. The lampshade 2 converges from the top end portion 23 to the bottom end portion 22. The inner inclined surface 21 extends from the bottom end portion 22 to the top end portion 23. In this embodiment, the lampshade 2 is made of glass, but is not limited thereto in other embodiments.

In this embodiment, the securing unit 3 has a cover shell 31 and three angularly spaced-apart locking mechanisms 320, but the number of the locking mechanisms 320 may vary in other embodiments.

The cover shell 31 is disposed in the opening 24, and has a top wall 311, a surrounding wall 312, and a plurality of receiving notches 313. The surrounding wall 312 extends downwardly from a periphery of the top wall 311, and is connected to the mounting plate 12 (see FIG. 9). Each of the receiving notches 313 extends from the top wall 311 to the surrounding wall 312. In this embodiment, the cover shell 31 has three receiving notches 313 that are angularly spaced apart from one another, but the number of the receiving notches 313 is not limited thereto in other embodiments. The locking mechanisms 320 are respectively received in the receiving notches 313, so the number of the receiving notches 313 is identical to that of the locking mechanisms 320.

Figure 6:
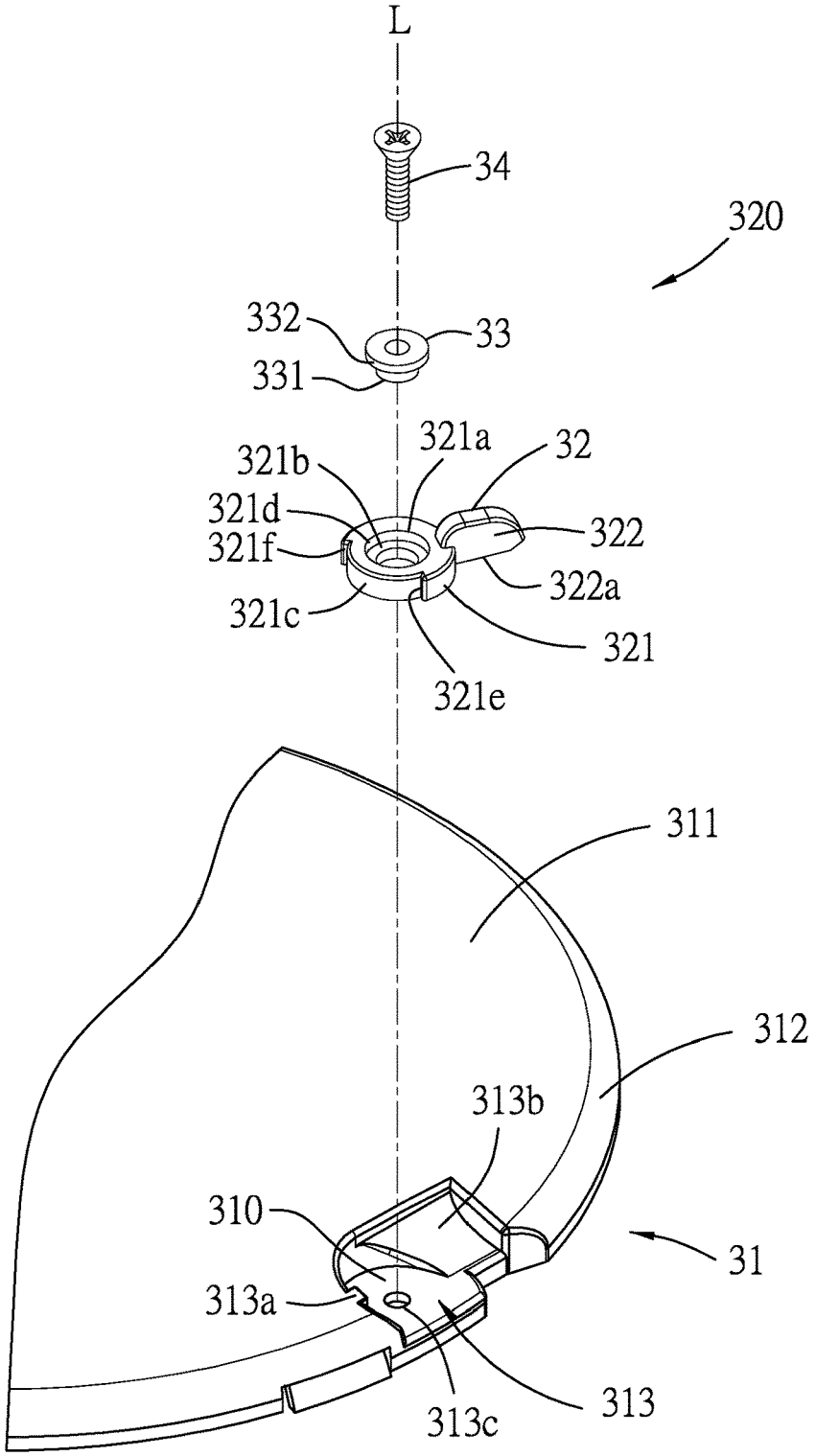
FIG. 6 is a fragmentary exploded perspective view of a securing unit of the embodiment.

Referring to FIG. 6, the cover shell 31 further has three protruding ribs 313*a* respectively projecting into the receiving notches 313. Each of the receiving notches 313 has a bottom end terminating at a groove bottom surface 310. The groove bottom surface 310 has an inclined surface section 313*b*, and is formed with a through hole 313*c* that is spaced apart from the inclined surface section 313*b*.

Since the structure of the receiving notches 313 and the locking mechanisms 320 are identical, only one receiving notch 313 and one locking mechanism 320 will be described in the following for the sake of brevity.

Figure 7:
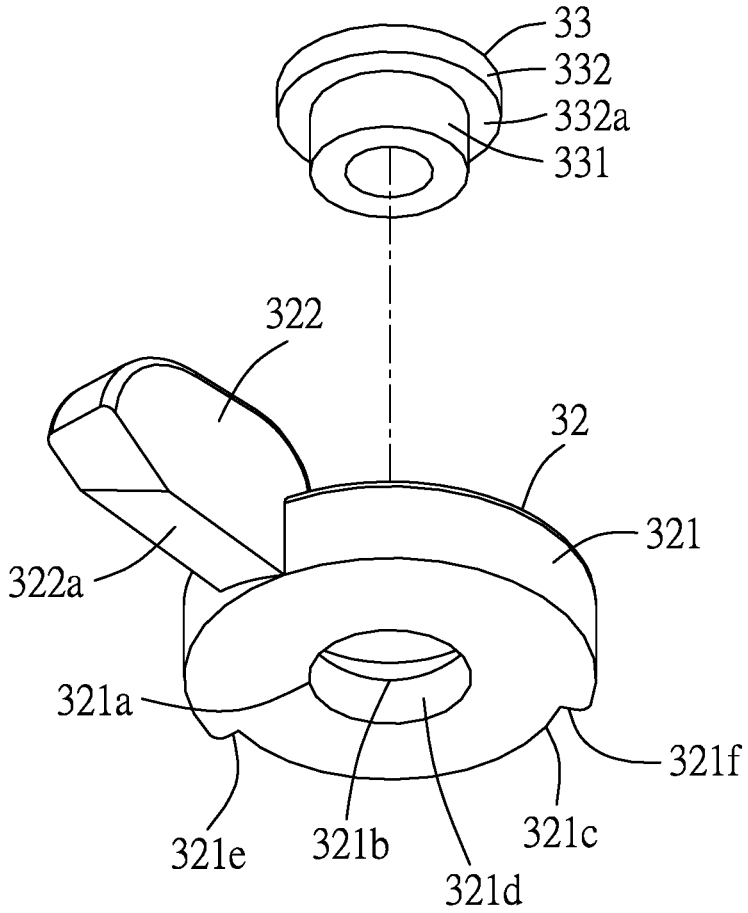
FIG. 7 is an exploded perspective view of a locking member and a tubular member of the securing unit.

Referring to FIGS. 6 and 7, the locking mechanism 320 has a locking member 32, a tubular member 33, and a screw member 34.

The locking member 32 has a ring portion 321 and an arm portion 322. The ring portion 321 surrounds an axis (L), is disposed in the receiving notch 313, and is rotatable about the axis (L) relative to the cover shell 31. The ring portion 321 has an inner surface 321*d* surrounding the axis (L), defining a coupling hole 321*a*, and having a stepped shoulder part that has an upward-facing shoulder surface portion 321*b*. The ring portion 321 is formed with a guiding recess 321*c* that has opposite ends terminating respectively at a locking end surface 321*e* and an unlocking end surface 321*f* of the ring portion 321 which are circumferentially spaced apart from each other. The protruding rib 313*a* is received in the guiding recess 321*c*. The arm portion 322 extends laterally from the ring portion 321, has an abutment bottom surface 322*a*, and is co-rotatable with the ring portion 321 about the axis (L) relative to the cover shell 31 between a locked position (see FIG. 10) and an unlocked position (see FIG. 8).

In this embodiment, at least a portion of the arm portion 322 is flexible. For example, the arm portion 322 may be made of a plastic material.

The tubular member 33 of the locking mechanism 320 has a tubular portion 331 and a flange portion 332. The tubular portion 331 is inserted into the coupling hole 321*a* of the ring portion 321 of the locking member 32. The flange portion 332 projects outwardly from a top end of the tubular portion 331, and has a bottom surface 332*a*.

Figure 10:
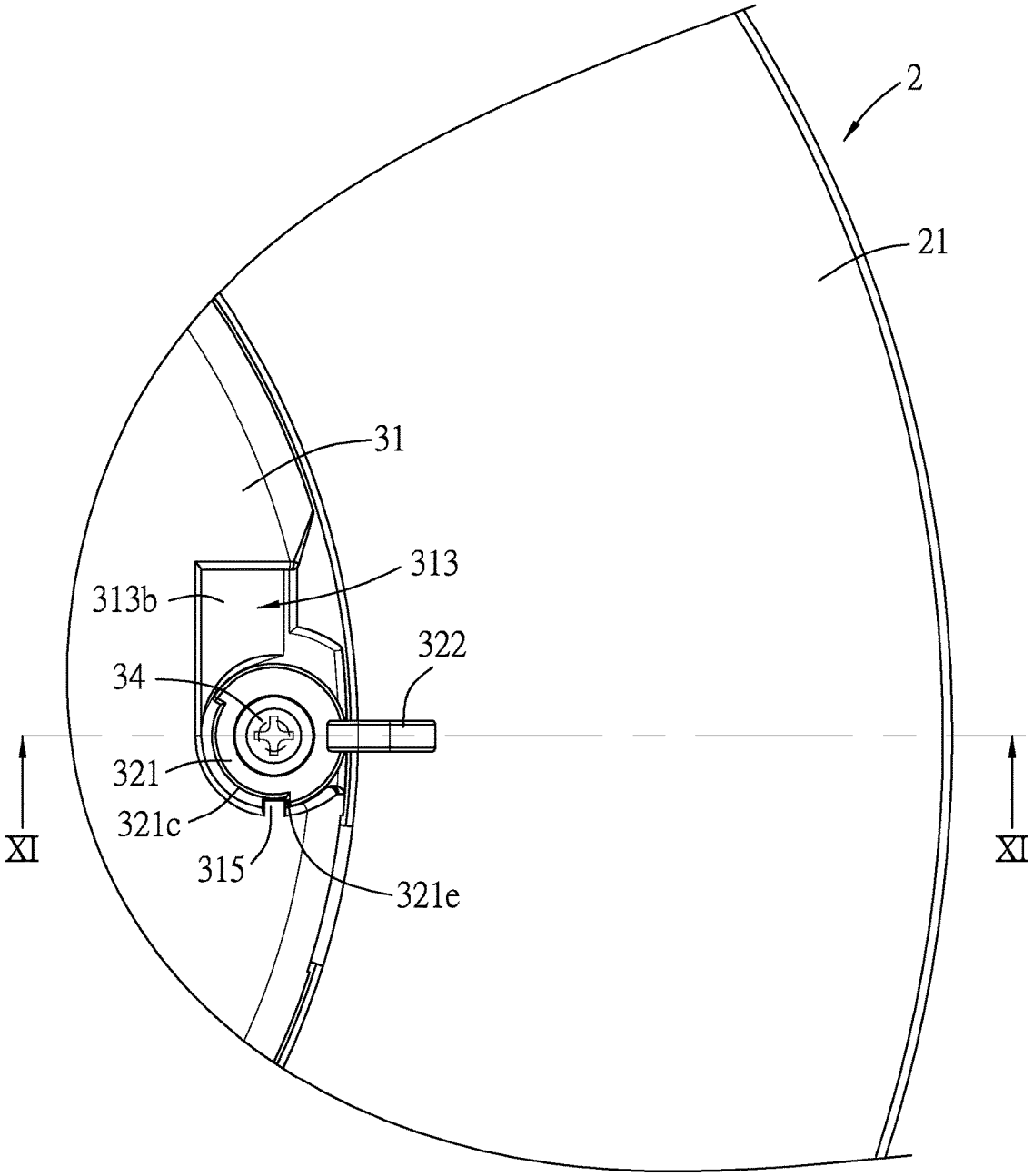
FIG. 10 is an enlarged fragmentary top view of the embodiment, illustrating an arm portion of the locking member being in a locked position.
Figure 11:
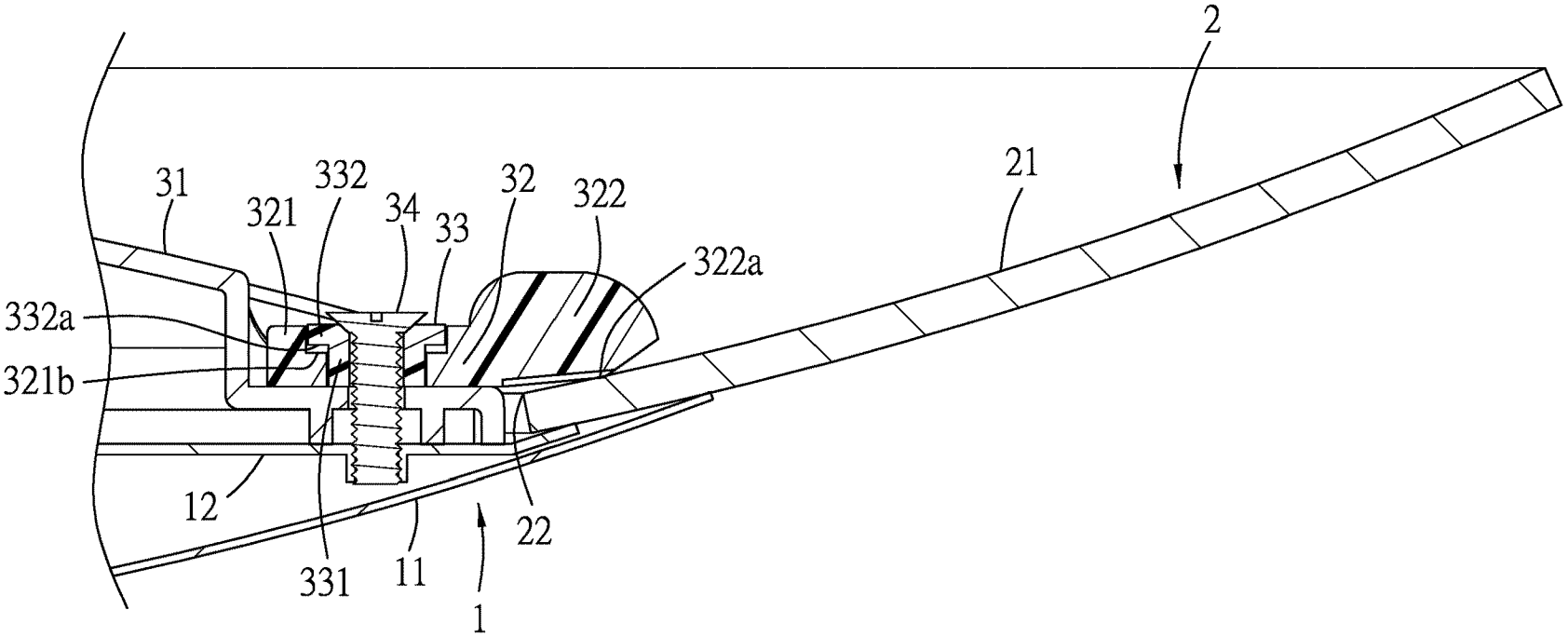
FIG. 11 is a fragmentary sectional view taken along line XI-XI in FIG. 10.

When assembling the lamp device 100 of the present disclosure, the screw member 34 is first applied to extend downwardly through the tubular portion 331 of the tubular member 33 and the through hole 313*c* of the cover shell 31 and to be threadedly secured onto the mounting plate 12 of the lamp seat 1. Then, the cover shell 31 is disposed in the opening 24 of the lampshade 2 with the surrounding wall 312 being connected to the bottom end portion 22 of the lampshade 2. Afterwards, the arm portion 322 is rotated about the axis (L) to the locked position, as shown in FIGS. 10 and 11, where the arm portion 322 is disposed outside of the receiving notch 313, and the abutment bottom surface 322*a* of the arm portion 322 abuts against the inner inclined surface 21 of the lampshade 2. When the arm portion 322 is in the locked position, the protruding rib 313*a* abuts against the locking end surface 321*e* of the ring portion 322. After all of the three locking mechanisms 320 are assembled with the arm portion 322 of the locking member 32 of each of the locking mechanisms 320 being pushed to the locked position, the lampshade 2 is fastened to the lamp seat 1.

Figure 8:
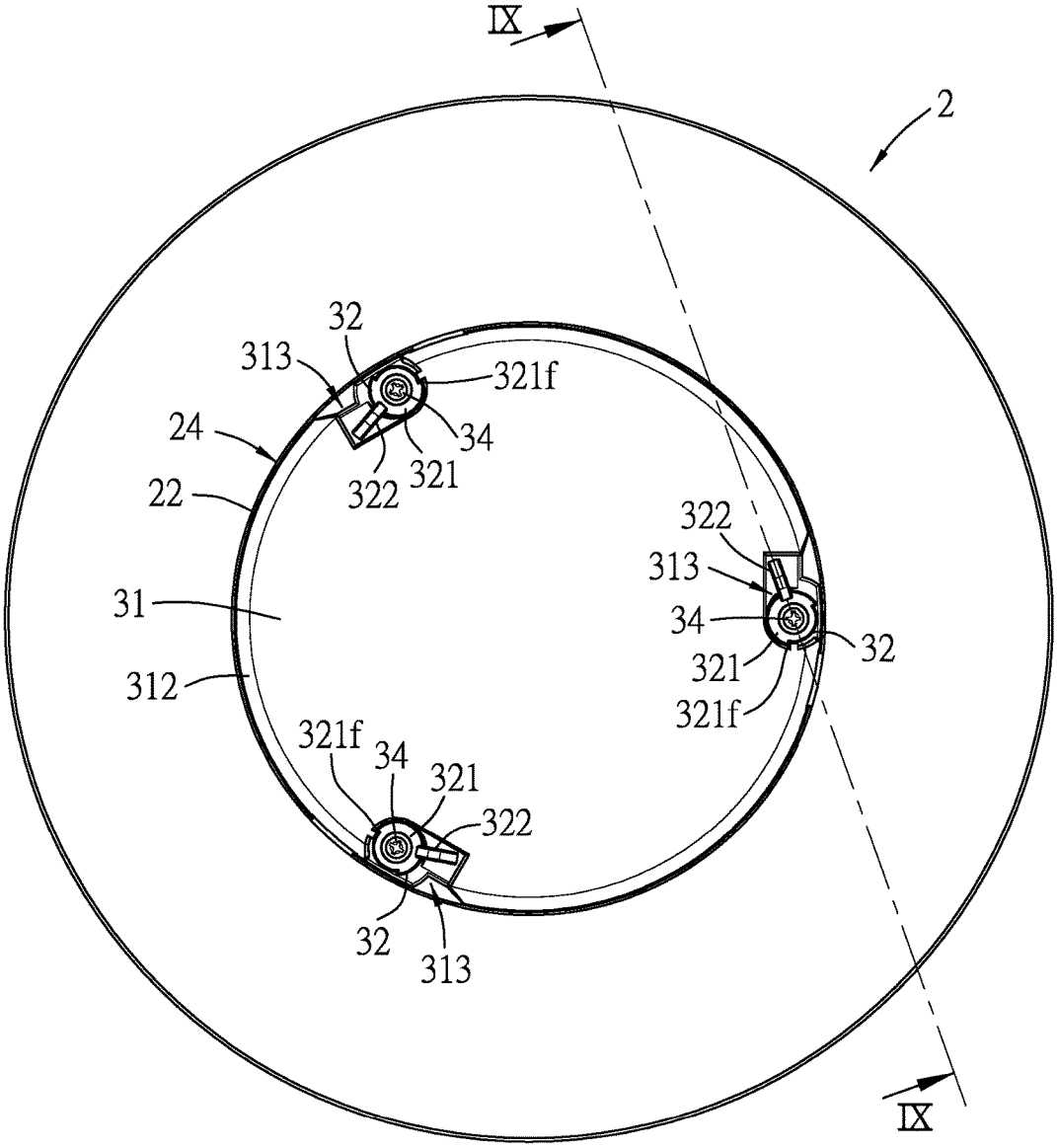
FIG. 8 is a top view of the embodiment.
Figure 9:
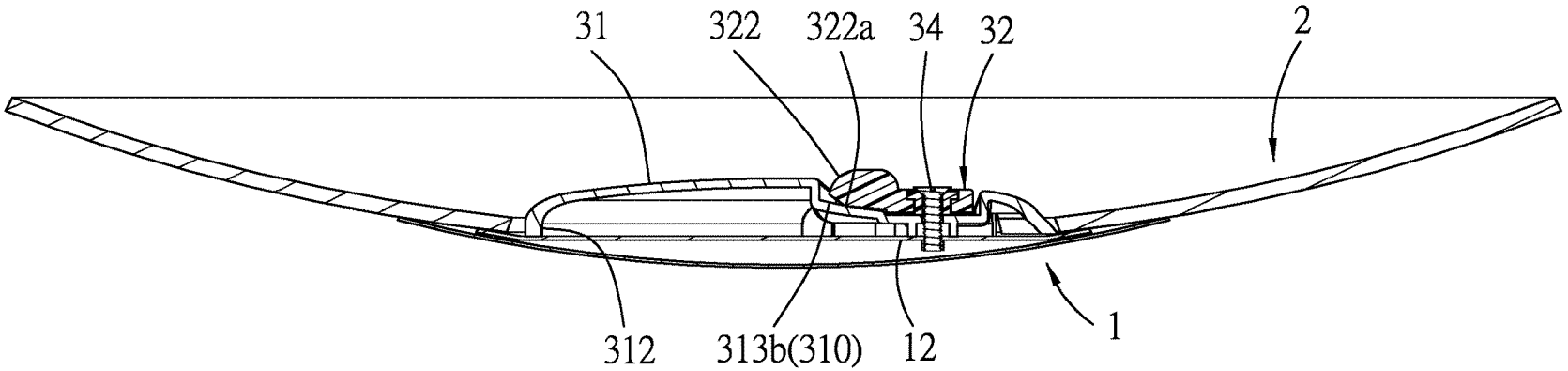
FIG. 9 is a sectional view taken along line IX-IX in FIG. 8.

When intending to disassemble the lampshade 2, a user needs to rotate the arm portion 322 to the unlocked position, as shown in FIGS. 8 and 9, where the arm portion 322 is received in the receiving notch 313. When the arm portion 322 is in the unlocked position, the protruding rib 313*a* abuts against the unlocking end surface 321*f* of the ring portion 321. After the arm portion 322 of the locking member 32 of each of the locking mechanisms 320 is pushed to the unlocked position, the lampshade 2 is permitted to be separated from the lamp seat 1. It should be noted that, for each locking mechanism 320, when the arm portion 322 is in the unlocked position, the abutment bottom surface 322*a* is in frictional contact with the inclined surface section 313*b* of the groove bottom surface 310, so as to retain the arm portion 322 in the unlocked position to prevent unintentional release of the arm portion 322 from the receiving notch 313, which would otherwise interfere with the separation of the lampshade 2 from the lamp seat 1.

It should be noted that, referring to FIG. 11, when the lamp device 100 is assembled, the top end of the tubular member 331 is higher than and spaced apart from the shoulder surface portion 321*b*, a bottom end of the tubular member 331 abuts against the cover shell 31, and the bottom surface 332*a* of the flange portion 332 is disposed over the shoulder surface portion 321*b* of the inner surface 321*d* of the locking member 32. When the screw member 34 is secured to the mounting plate 12 of the lamp seat 1, a head portion of the screw member 34 is supported by the flange portion 332 without directly pressing the locking member 32, thus the arm portion 322 can be easily rotated between the locked and unlocked positions.

Figure 12:
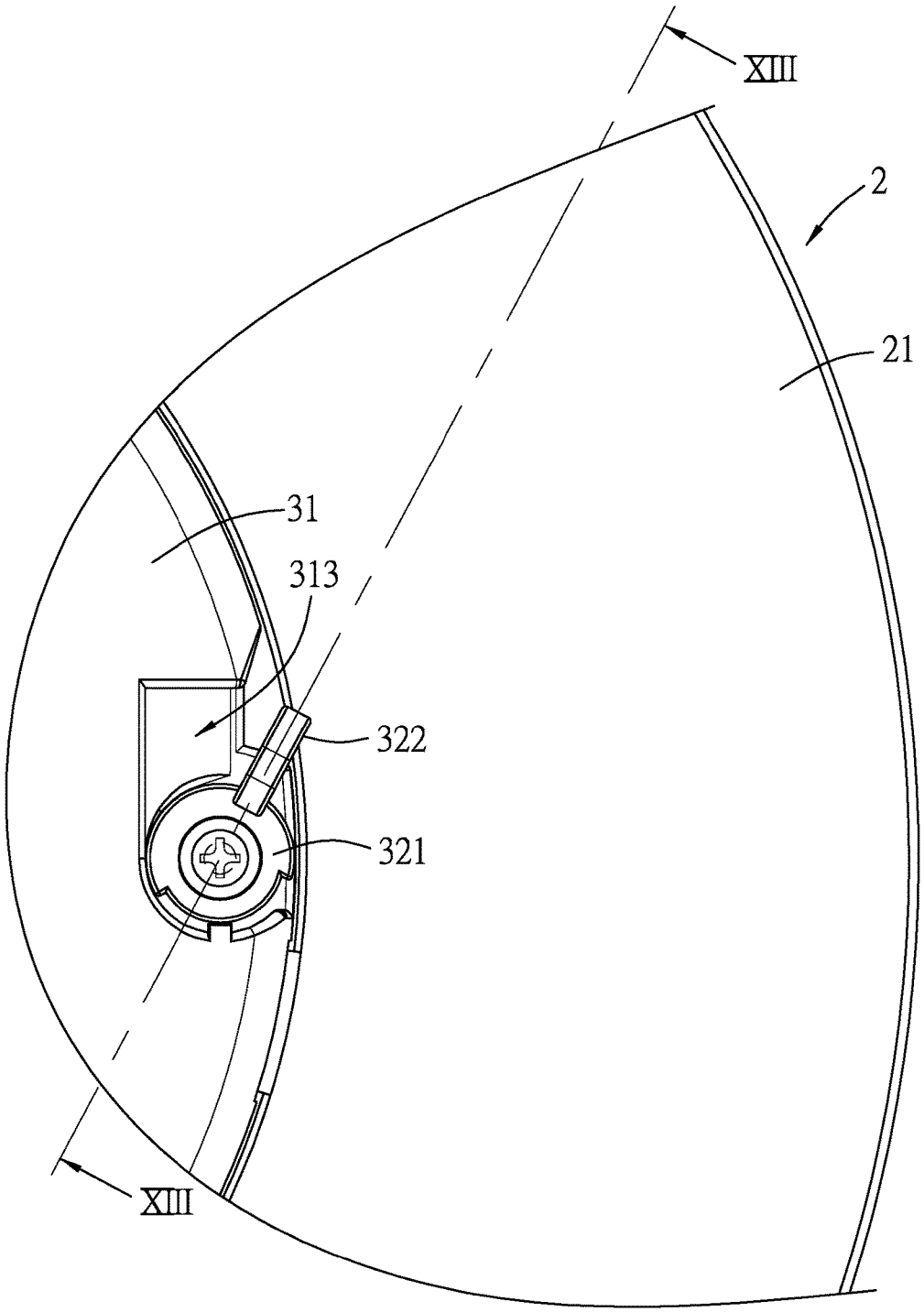
FIG. 12 is another enlarged fragmentary top view of the embodiment.
Figure 13:
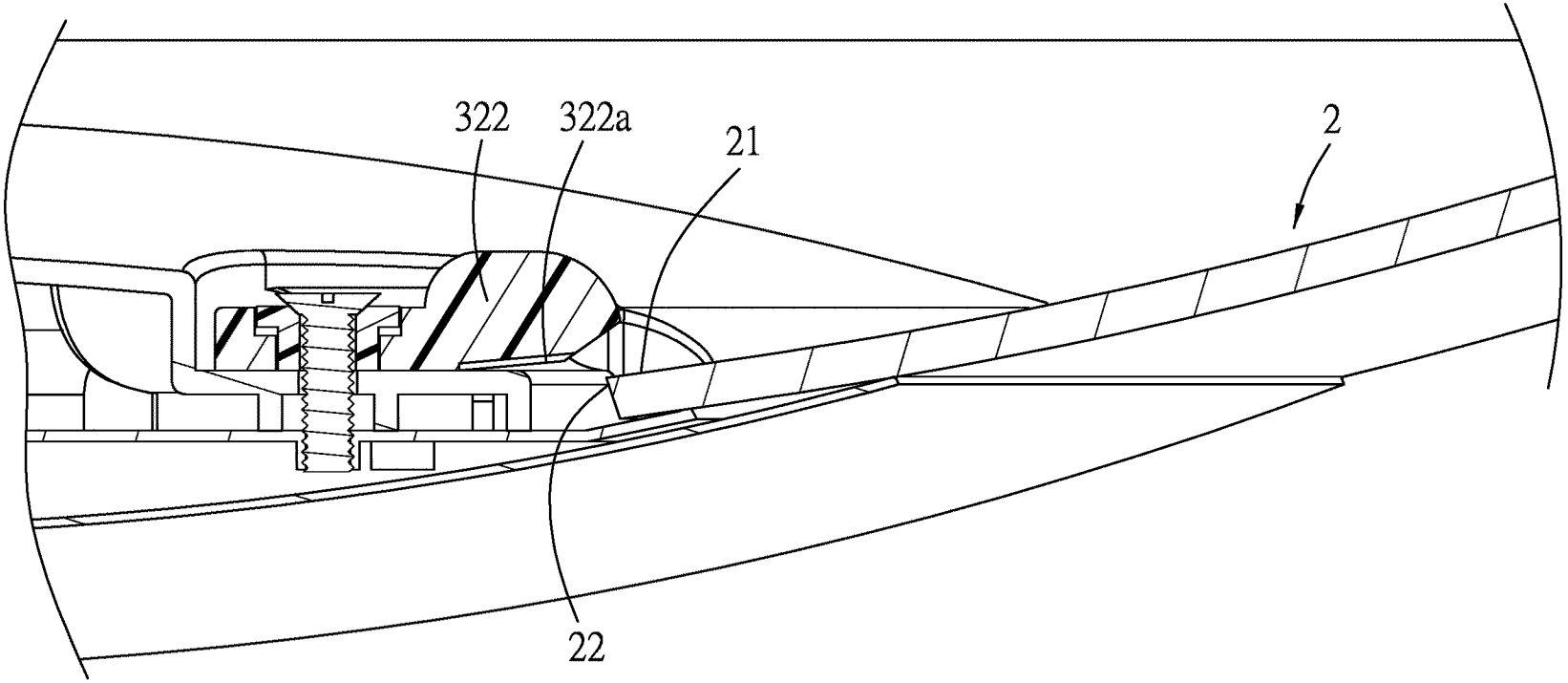
FIG. 13 is still another fragmentary sectional view of the embodiment taken along line XIII-XIII in FIG. 12.

Also referring to FIG. 11, when the lamp device 100 is assembled, the abutment bottom surface 322*a* of the arm portion 322 is inclined upwardly in a direction away from the ring portion 321, and is disposed higher than the bottom end portion 22 of the lampshade 2. With such configuration, the arm portion 322 would not have contact with the inner inclined surface 21 of the lampshade 2 when the locking member 32 is not yet in the locked position, thereby facilitating the rotation of the arm portion 322 from the unlocked position to the locked position. As such, referring to FIGS. 12 and 13, the abutment bottom surface 322*a* of the arm portion 322 is spaced apart from the inner inclined surface 21.

It should be noted that by virtue of the configuration of the protruding rib 313*a* of the cover shell 31 and the guiding recess 321*c* of the ring portion 321, the arm portion 322 is limited to be rotated between the locked and the unlocked positions, thus the lampshade 2 of the lamp device 100 of the present disclosure is unlikely to fracture in comparison with that of the aforesaid conventional lamp device 9.

In view of the foregoing, with the arm portion 322 being rotated to the locked position, the lampshade 2 can be easily fastened to the lamp seat 1 by the user, thus the lamp device 100 is not required to be assembled before transportation, thereby resulting in convenience and reducing the price of sales of the lamp device 100. Moreover, since at least one portion of the arm portion 322 is flexible, fracture of the lampshade 2 is prevented when the arm portion 322 abuts against the lampshade 2.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular future, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A lamp device comprising:

a lamp seat including a mounting plate;

a funnel-shaped lampshade having a top end portion, a bottom end portion that is spaced apart from said top end portion, that is connected to said mounting plate, and that defines an opening, said lampshade converging from said top end portion to said bottom end portion, and an inner inclined surface that extends from said bottom end portion to said top end portion; and a securing unit having a cover shell that is disposed in said opening and that has a top wall, a surrounding wall extending downwardly from a periphery of said top wall, and connected to said mounting plate, and a plurality of receiving notches, each of which extends from said top wall to said surrounding wall, and a plurality of locking mechanisms, each of which includes a locking member that has a ring portion disposed in a respective one of said receiving notches and being rotatable about an axis relative to said cover shell, and an arm portion extending laterally from said ring portion, and being co-rotatable with said ring portion about the axis relative to said cover shell between a locked position, where said arm portion is disposed outside of the respective one of said receiving notches and abuts against said inner inclined surface of said lampshade such that said lampshade is fastened to said lamp seat, and an unlocked position, where said arm portion is received in the respective one of said receiving notches such that said lampshade is permitted to be separated from the lamp seat.

2. The lamp device as claimed in claim 1, wherein said arm portion of said locking member of each of said locking mechanisms has an abutment bottom surface disposed higher than said bottom end portion of said lampshade, and inclined upwardly in a direction away from said ring portion so as not to contact with said inner inclined surface of said lampshade when said arm portion of said locking member is not in the locked position.

3. The lamp device as claimed in claim 1, wherein:

said ring portion of said locking member of each of said locking mechanisms is formed with a guiding recess that has opposite ends terminating respectively at a locking end surface and an unlocking end surface of said ring portion which are circumferentially spaced apart from each other; and said cover shell of said securing unit further has a plurality of protruding ribs respectively projecting into said receiving notches, each of said protruding ribs being received in said guiding recess of said ring portion of said locking member of a respective one of said locking mechanisms, abutting against said locking end surface when said arm portion of said locking member of the respective one of said locking mechanisms is in the locked position, and a butting against said unlocking end surface when said arm portion of said locking member of the respective one of said locking mechanisms is in the unlocked position.

4. The lamp device as claimed in claim 3, wherein:

each of said receiving notches has a bottom end terminating at a groove bottom surface, said groove bottom surface having an inclined surface section; and for said locking member of each of said locking mechanisms, when said arm portion is in the unlocked position, said abutment bottom surface of said arm portion is in frictional contact with said inclined surface section of said groove bottom surface which corresponds to the respective one of said receiving notches.

5. The lamp device as claimed in claim 4, wherein:

said ring portion of said locking member of each of said locking mechanisms further has an inner surface surrounding the axis, defining a coupling hole, and having a stepped shoulder part that has an upward-facing shoulder surface portion;

each of said locking mechanisms further includes a tubular member having a tubular portion that is inserted into said coupling hole of said ring portion of said locking member, and that has a top end higher than and spaced apart from said shoulder surface portion, and a flange portion that projects outwardly from said top end of said tubular portion, and that has a bottom surface disposed over said shoulder surface portion, and a screw member extending downwardly through said tubular portion and said cover shell, and threadedly secured onto said mounting plate of said lamp seat.

6. The lamp device as claimed in claim 1, wherein at least a portion of said arm portion of said locking member of each of said locking mechanisms is flexible.

* * * * *